United States Patent [19]

Morcheles

[11] Patent Number: 4,564,886

[45] Date of Patent: Jan. 14, 1986

[54] PORTABLE LIGHT BOX

[75] Inventor: Bernard Morcheles, Short Hills, N.J.

[73] Assignee: Stacor Corporation, Newark, N.J.

[21] Appl. No.: 433,254

[22] Filed: Oct. 7, 1982

[51] Int. Cl.[4] ..... G09F 13/04; F21L 15/12

[52] U.S. Cl. ..... 362/97; 362/220; 362/240; 362/282; 362/287; 362/311; 362/399; 108/23; 40/361

[58] Field of Search ..... 362/97, 399, 98, 311, 362/220, 240, 282, 287; 108/23; 339/54; 40/361, 564, 574, 366, 367; 49/163, 168

[56] References Cited

U.S. PATENT DOCUMENTS

| | | | |
|---|---|---|---|
| 1,704,420 | 3/1929 | Bailey | 49/163 |
| 2,254,706 | 9/1941 | Mueller et al. | 339/54 |
| 2,328,471 | 8/1943 | Leffel | 362/97 X |
| 3,811,212 | 5/1974 | Wright | 40/367 |
| 4,390,257 | 6/1983 | Fernekes et al. | 40/367 X |

FOREIGN PATENT DOCUMENTS

| | | | |
|---|---|---|---|
| 750111 | 1/1967 | Canada | 40/574 |
| 1162175 | 9/1958 | France | 40/361 |
| 536468 | 5/1941 | United Kingdom | 40/367 |

*Primary Examiner*—Stephen C. Bentley
*Assistant Examiner*—John S. Maples
*Attorney, Agent, or Firm*—Yuter, Rosen & Dainow

[57] ABSTRACT

A portable light box having a light tray, with a cover having an aperture therein with the cover hinged to the light tray. A diffuser is secured in the aperture. A base is also hinged to the light tray. Bail means releasably lock the cover to the light tray, thereby securing the diffuser in the aperture, and may function as a carrying handle or an easel strut to support the light tray at a predetermined angle to the base.

10 Claims, 12 Drawing Figures

PORTABLE LIGHT BOX

BACKGROUND OF THE INVENTION

This invention generally relates to light boxes and particularly light boxes comprising an enclosure having at least one side partially surfaced with a light diffuser and having therein electric lamps.

PRIOR ART

Light boxes having at least one surface partially comprising a light diffuser, often frosted glass or plastic, are old. Most prior art light boxes comprise a rectangular enclosure. One or more incandescent or fluorescent lamps are placed within the box near the bottom surface. An aperture is provided in the top surface of the light box, which often has a recessed flange on which the diffuser sat in order that the top side of the glass was flush with the remainder of the top surface of the light box. However, if the unit was moved, the diffuser, often glass, was liable to become dislodged from the box, fall and break.

More often than not these prior art devices were relatively heavy and bulky. In order to increase the diffusion and avoid hot spots in the diffuser, the prior art boxes were deep in order to place the lamps as far from the glass as possible. In short, the portability of these units was extremely limited.

Some prior art light boxes incorporated some features of portability. In one such box the top surface of the light box was entirely covered with the diffuser. This diffuser was fastened to the light box through recessed screws, thus preserving the flush surface necessary for efficient use of drawing instruments. An ordinary suitcase handle was fastened to one side of the box to provide means to carry the box from spot to spot.

In addition to other shortcomings these devices were not truly self-contained. For example, it is often desired to support a light box at an angle to the normally horizontal desk or table top. For this purpose most prior art devices provided a separate easel. For example, in one prior art device a wire strut was provided which had to be carried separately from the light box. In another prior art device the light box itself was trapezoidal in crosssection, thus having a designed-in easel shape. This however, caused the light box to have a larger crosssection than would be necessary to provide the basic light box functions.

SUMMARY OF THE INVENTION

Accordingly, it is an object of the present invention to provide a light box which is easily portable.

It is another object of the present invention to provide for such a light box in which the diffuser is flush with the top surface of the light box.

It is a further object of the present invention to provide such a light box in which the diffuser is sufficiently secured so that the light box may be transported or inclined at an angle without risk of dislodging the diffuser.

It is a further object of the present invention to provide such a light box that is relatively slim in profile.

It is a further object of the present invention to provide such a light box that has a built-in easel to support the light box at an angle to a horizontal surface upon which it sits.

It is a further object of the present invention to provide such a light box in which the lamps located therein are secured and not subject to being dislodged.

It is a further object of the present invention to provide such a light box which is attractive and pleasing, yet relatively easily and inexpensively manufactured and assembled.

In accordance with the preferred embodiment of the present invention, the above and other objects are obtained by a portable light box having a light tray. A cover, having an aperture therein, is hinged to the light tray. A diffuser is secured in said aperture. A base is also hinged to the light tray. Bail means releasably lock said cover to said light tray, thereby securing the diffuser in the aperture, and may function as a carrying handle or an easel strut to support the light tray at a predetermined angle to the base.

DESCRIPTION OF THE DRAWINGS

A more complete appreciation of the invention and all of its attendant features may be readily apparent by reference to the following description when considered in connection with the accompanying drawings.

DETAILED DESCRIPTION OF THE PREFERRED EMBODIMENT

Figure 1:
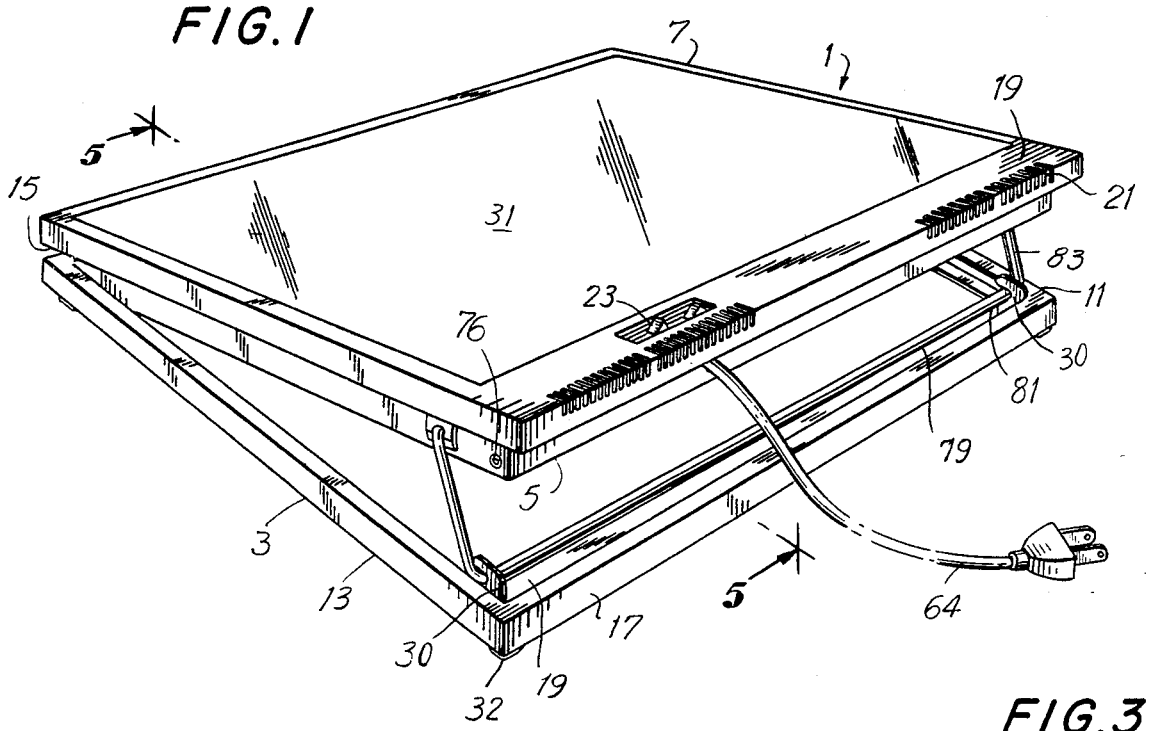
FIG. 1 is a back perspective view of the preferred embodiment of the portable light box pursuant to the present invention.
Figure 2:
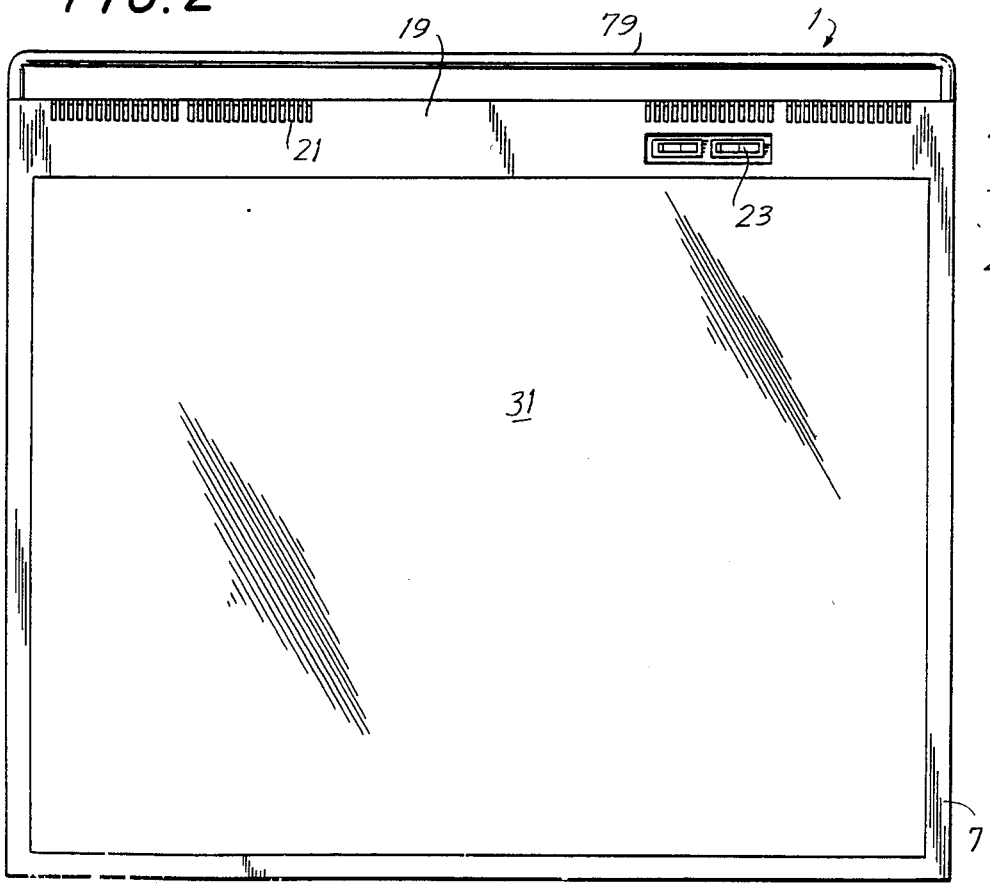
FIG. 2 is a top plan view thereof.

Referring to the figures, the preferred embodiment of the present invention is shown. Light box 1 comprises a base 3, a light tray 5 and a cover 7. Light box 1 is constructed from sheet metal, such as a steel or aluminum, and bent is and joined in the conventional manner. In the preferred embodiment joinder is preferably by welding, except for particular places where pop rivets are used, as described more fully below. Naturally, one skilled in the art could substitute other materials or joinder techniques without departing from the spirit of the invention.

As is evident from the drawings base 3 and cover 7 are identical except for a few features. Accordingly, only base 3 will be described in detail with comments regarding the features distinguishing base 3 from cover 7. With respect to base 3 and cover 7 like parts will carry the same reference number.

Base 3 comprises a frame 9 having sides 11 and 13, front 15, and back 17. In the preferred embodiment sides 11 and 13 and front 15 comprise "U" channels, the opening of which faces inwards and the legs of which are of equal length.

Back 17 also comprises a U-channel. However, leg 19 of the U-channel forming back 17 is substantially longer than the other leg. Leg 19 of base 3 is on the underside of base 3 and leg 19 of cover 7 is on the upper surface of cover 7.

Near the corners where sides 11 and 13 of base 3 meet back 17, "C" retainers 30 are located on the inside of sides 11 and 13. "C" retainers 30 are generally in the shape of a "C", with the bottom edge of the opening flush with the top edge of base 3 and facing toward the front of light box 1. Pads 32 are provided on the bottom of base 3 to protect the surface on which light box 1 rests and to prevent movement along that surface.

Referring now to cover 7, cover 7 has on its leg 19 louvers 21. In the preferred embodiment louvers 21 serve principally as ornaments. However, as will be obvious to one skilled in the art by making suitable ventilation louvers in light tray 5, louvers 21 can also serve to aid ventilation of light tray 5.

Two switches 23 are also provided in light box 1. In the preferred embodiment switches 23 are placed through openings 25 cut in leg 19 of cover 7. Each of switches 23 control two fluorescent lamps which are located in light tray 5. Of course, one skilled in the art could vary the number of switches or lamps.

Extending from the underside of cover 7 at sides 11 and 13 a short distance from back 17 are tabs 27. Each of tabs 27 has a hole 29 which, when cover 7 is properly closed upon light tray 5, align with complementary holes in light tray 5 for locking cover 7 to light tray 5 as more fully described below.

Located in the aperture formed in cover 7 is diffuser 31. In the preferred embodiment diffuser 31 is a semi-opaque material such as opal plastic, which diffuses light.

Figures 6, 7, 8, 9, 10, 11:
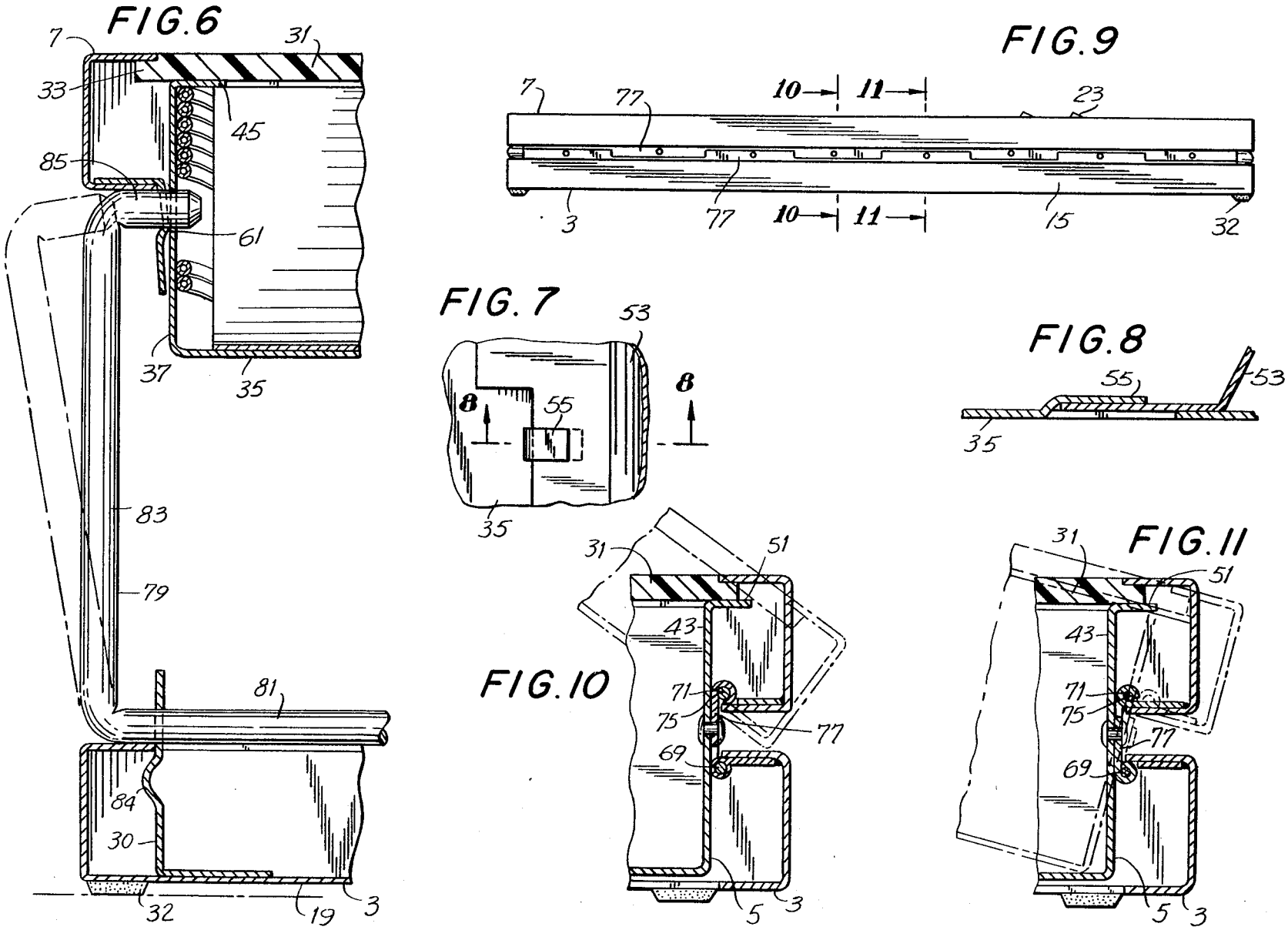
FIG. 6 is a sectional view thereof along line 6—6 of FIG. 5.
FIG. 7 is a sectional view thereof along line 7—7 of FIG. 5.
FIG. 8 is a sectional view thereof along line 8—8 of FIG. 7.
FIG. 9 is a left side view thereof.
FIG. 10 is a sectional view thereof along line 10—10 of FIG. 9.
FIG. 11 is a sectional view thereof along line 11—11 of FIG. 9.

As can clearly be seen in FIG. 6, diffuser 31 has perimeter rabbet 33. Perimeter rabbet 33 can be machined or cast into diffuser 31. Perimeter rabbet 33 engages the underside of the upper leg of the U channels of frame 9 of cover 7. As described below the lower surface of diffuser 31 engages the outer surface of the flanges 45 of light tray 5. When cover 7 is closed down upon light tray 5 diffuser 31 is held securely in light box 1 with the outer surface of diffuser 31 flush with the outer surface of cover 7.

Figures 4, 5, 12:
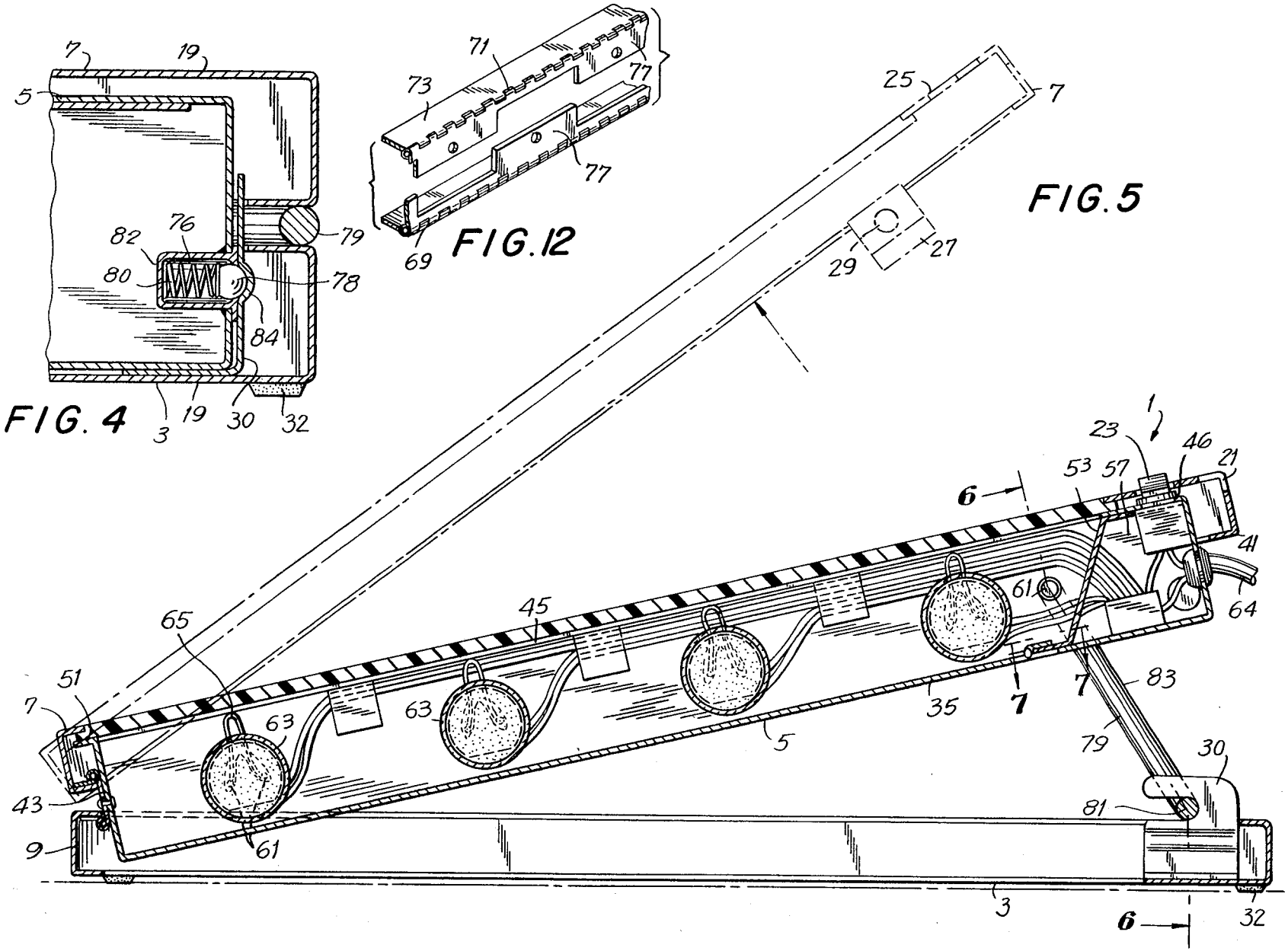
FIG. 4 is a partial sectional view thereof along the line 4—4 of FIG. 3.
FIG. 5 is a sectional view thereof along line 5—5 of FIG. 1.
FIG. 12 is a partial perspective view of the hinges.

Referring principally to FIGS. 5 and 6 light tray 5 comprises a bottom 35, sides 37, back 41 and front 43. Also provided are side flanges 45, each of which extends from the top edge of sides 37 inwards towards the center of light tray 5. As described above flanges 45 engage the underside of diffuser 31 and securely hold diffuser 31 in cover 7.

Back flange 46 extends from the top edge of back 41 inward toward the interior of light tray 5. A front flange 51 extends outward from the interior of light tray 5 from the top edge of front 43.

In each of sides 37 near back 41 a hole 67 is located. When cover 7 closes down upon light tray 5, holes 29 in tabs 27 of cover 7 align with holes 67.

Referring to FIGS. 5, 7, and 8 Z-shaped separator 53 extends from under back flange 46 to and along bottom 35. Separator 53 is held against bottom 35 by tabs 55. The interior of light tray 5 is painted with reflective color (e.g., white).

Separator 53, back flange 46, back 41, and sides 37 form a compartment 57. In compartment 57 there are contained ballasts (not shown) for the fluorescent lamps. In the preferred embodiment of the present invention fluorescent ballasts are pop riveted to back 41. Light tray 5 thus forms a heat sink for the heat-producing ballasts. Also extending into compartment 57 are switches 23 which are mounted on back flange 46.

As best shown in FIG. 5 light tray 5 has mounted on sides 37 fluorescent lamp sockets 63. In the preferred embodiment there are sockets 63 for four lamps. As is customary in the art, contact pins 61 of fluorescent lamps (not shown) fit into socket 63. Retainer clips 65 snap into the passages in socket 63 through which contact pins 61 enter. In the preferred embodiment retaining clips 65 are generally of a "U" shape and made of a resilient material. The legs of clips 65 are pressed together to permit those legs to fit in the passages in sockets 63 and then expand to hold clips 65 in place. Clips 65 are also of sufficient height such that, when they are locked into sockets 63, they contact the underside of side flanges 45. Retainer clips 65 thus are positively locked into sockets 63, preventing pins 61 of the fluorescent lamps from accidentally falling out of sockets 63 during movement or tilt of light box 1. Retainer clips 65 could also be formed from extruded material of cross-sectional design so as to conform to the internal configuation of sockets 63.

In the illustrated embodiment light tray 5 is relatively shallow. Thus, the fluorescent lamps are relatively close to the underside of diffuser 31. Assuming that the fluorescent lamps are sufficiently bright, hot spots in the diffuser may be created. To increase diffusion of light, the top surface of the fluorescent lamps can be painted with a translucent or opaque color. This eliminates all or most of the direct radiation from the lamps onto the diffuser 31 and the hot spots created thereby.

Referring to FIGS. 9–12 hinges 69 and 71 that join base 3 and cover 7 to light tray 5, respectively, are shown. Hinges 69 and 71 are identical. Each of hinges 69 and 71 comprise a continuous leaf 73, a pin 75 and a stepped leaf having a plurality of leaf segments 77. The length of each leaf segment 77 is identical to the space between adjacent leaf segments 77. Pin 75 joins leaf 73 to leaf segments 77 in the conventional manner generally known as a "piano hinge".

Continuous leaf 73 of hinge 69 is welded to the interior side of the upper leg of the U-channel forming front 15 of base 3. Each of leaf segments 77 is pop riveted to front 43 of light tray 5. Similarly, leaf 73 of hinge 71 is welded to the interior side of the bottom leg of the U-channel forming front 15 of cover 7. Each of the leaf segments 77 of hinge 71 is also pop riveted to front 43 of light tray 5. As best seen in FIGS. 9 and 12, leaf segments 77 of hinge 69 interweave with leaf segments 77 of hinge 71 when pop riveted properly in place against front 43 of light tray 5.

In the preferred embodiment the size of light tray 5 is such that it can fit within the aperture formed by the short legs of the U-channel forming frames 9 of both base 3 and cover 7. However, light tray 5 cannot pass fully through frames 9 because of longer leg 19 and restraint provided by hinges 69 and 71.

Referring to FIG. 4 a spring-loaded detent 76 comprising a ball 78 and spring 80 are provided in a housing 82 located in sides 37 of light tray 5 near back edge 41. Ball 78 engages a recess 84 in "C" retainers 30 to releasably lock base 3 to light tray 5, when base 3 is closed down and around light tray 5.

As one skilled in the art will readily recognize cover 7 and base 3 rotate about hinges 71 and 69, respectively. In so doing, because of the dimensions of the apertures in base 3 and cover 7, they partially enclose the perimeter of light tray 5. Furthermore, as noted above, when cover 7 rotates around hinge 71 to enclose light tray 5, perimeter flange 33 of diffuser 31 engages the underside of cover 71 and the outer surfaces of flanges 45, 46 and 51 and becomes locked in place. As noted above when cover 7 closes upon light tray 5, holes 29 of cover 7 align with holes 67 of light tray 5.

Referring to FIGS. 1 and 6 bail 79 has a long straight portion 81. Two relatively short legs 83, extending from each end of the straight portion 81, are perpendicular to the straight portion 81. Pins 85 are located at the ends of short legs 83 and are perpendicular thereto. Bail 79 has sufficient resiliency so that pins 85 can pass through both sets of holes 29 and 67 and thus releasably lock cover 7 to light tray 5 (see FIG. 6). Portion 81, legs 82 and pins 85 in the preferred embodiment are formed by bending a continuous rod.

Figure 3:
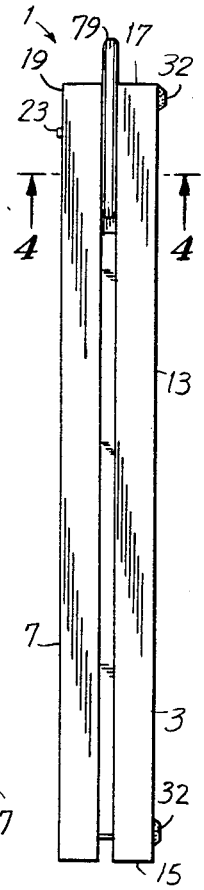
FIG. 3 is a right side view thereof in a closed state.

Further, bail 79 can rotate about pins 85. When light box 1 is collapsed, i.e., cover 7 and base 3 are closed about light tray 5, bail 79 can be rotated into the plane of light box 1 and provide means to permit the easy carrying of light box 1 (see FIG. 3). On the other hand, when base 3 and light tray 5 are opened, bail 79 can be rotated to permit long straight portion 81 to enter "C" retainers 30. (See FIGS. 1 and 5). In this position bail 79 acts as an easel strut and places diffuser 31 at an angle to the surface upon which base 3 rests.

Having now described the preferred embodiment of the present invention many of the attendant features and advantages can be perceived. First the light box of the present invention permits particularly easy and economical manufacture and assembly. For example, because both base 3 and cover 7 are substantially identical in design, economies of tooling, inventory, and production are easily realized.

The design of hinges 69 and 71 also permits easy manufacture and finishing of light box 1. That is, in the preferred embodiment cover 7 and base 3 are of a different color than light tray 5. Accordingly, each of base 3, light tray 5, and cover 7 can be painted separately and then joined by pop riveting, which does not endanger the already painted surfaces. Furthermore, because of the interleaved design of leaf segments 77 of hinges 69 and 71, each of leaf segments 77 are relatively deep, permitting easy access to pop rivet leaf segments 77 to light tray 5.

Also, when fully closed, light box 1 is extremely slim. Moreover, it has an integral handle and easel strut. Thus, the light box in the present invention is an attractive, relatively compact, and portable light box.

While the invention has been described by a specific embodiment and suggested variations, it is not limited thereto. Obvious modifications will occur to those skilled in the art. For example, the materials out of which the light box can be constructed may vary from the preferred metals to various plastics, or the number of lamps or switches can be varied from that illustrated to any given number, or the cord could be self-retracting. Another possible variation would be to have the cord exit on side 37 and provide means to store the cord, when light box 1 is closed, in the recess formed between cover 7 and base 3.

In the illustrated embodiment, the only ventilation of heat from light tray 5 is through the naturally loose fit of the various parts over one another and in particular cover 7 over light tray 5. This amount of ventilation has been found adequate in a practical use. However, one skilled in the art could easily create additional ventilation by adding ventilation louvers in light tray 5.

Thus, one skilled in the art could create various modifications without departing from the scope of this invention as defined by the following claims.

I claim:

1. A portable light box comprising:

(a) a light tray;

(b) a light source arranged in said light tray;

(c) a cover hinged to said light tray for relative rotation of said cover about an axis, said cover being provided with an aperture;

(d) a diffuser arranged in said aperture;

(e) a base hinged to said light tray for relative rotation of said base about an axis; and (f) bail means arranged to releasably engage said cover and said light tray, whereby said cover and light tray can be coupled, and arranged to rotate about an axis defined by said coupling, said bail means having first and second positions, wherein said bail means supports said cover and said light tray at a predetermined angle of inclination with respect to said base when said bail means is in said first position, and said bail means extends outside of said light box for use as a carrying handle when said bail means is in said second position and said cover is closed with respect to said base.

2. A portable light box as defined in claim 1 wherein said base comprise bail retaining means, and said bail means cooperates with said bail retaining means in said first position.

3. A portable light box as defined in claim 1 wherein said cover and said base each comprise a frame having the shape of a rectilinear parallelepiped and having an aperture for respectively allowing the upper portion of said light tray to protrude into the space defined by the shape of said cover and for allowing the lower portion of said light tray to protrude into the space defined by the shape of said base, said cover and base thereby substantially enclosing said light tray in a clam shell-type manner.

4. A portable light box as defined in claim 1, further comprising a plurality of electric lamps arranged in said light tray.

5. A portable light box as defined in claim 1, further comprising first and second piano hinges for respectively hinging said cover and said base to said light tray, wherein each of said piano hinges comprises a stepped leaf having a plurality of leaf segments, said stepped leaves being affixed to a surface of said light tray and arranged such that said respective leaf segments form an interleaved pattern.

6. A portable light box as defined in claim 1 wherein said bail means has two ends and a bright therebetween, and said cover and said light tray each have two holes in which said ends of said bail means are removably inserted to couple said cover and said light tray, said ends being in rotatable engagement with said holes and said bight being sufficiently flexible to allow said ends to be removed from said holes to uncouple said cover and said light tray.

7. A portable light box as defined in claim 3 wherein said aperture of said cover for receiving said diffuser opposes said aperture for enclosing said light tray, and said diffuser comprises a rigid plate of translucent material.

8. A portable light box as defined in claim 7 wherein said diffuser is provided with a rabbet about its periphery for engaging said cover such that said diffuser is flush with the upper surface of said cover.

9. A portable light box as defined in claim 7 wherein said light tray is provided with flanges that abut the underside of said diffuser when said cover and said light tray are coupled by said bail means.

10. A portable light box as defined in claim 7, wherein said cover and said base have identical structures.

* * * * *